US007800291B2

(12) United States Patent
Beers et al.

(10) Patent No.: US 7,800,291 B2
(45) Date of Patent: Sep. 21, 2010

(54) LOW WATTAGE FLUORESCENT LAMP

(75) Inventors: William W. Beers, Chesterland, OH (US); Gary R. Allen, Chesterland, OH (US); Bruce Roberts, Mentor on the Lake, OH (US); Gregory Brown, Cincinnati, OH (US)

(73) Assignee: General Electric Company, Schenectady, NY (US)

( * ) Notice: Subject to any disclaimer, the term of this patent is extended or adjusted under 35 U.S.C. 154(b) by 655 days.

(21) Appl. No.: 11/746,425

(22) Filed: May 9, 2007

(65) Prior Publication Data

US 2008/0278073 A1 Nov. 13, 2008

(51) Int. Cl.
*H01J 1/62* (2006.01)

(52) U.S. Cl. ..... 313/485; 315/291

(58) Field of Classification Search ..... 313/485; 315/291; 439/236

See application file for complete search history.

(56) References Cited

U.S. PATENT DOCUMENTS 3,780,329 A 12/1973 Otsuka et al.
3,780,330 A 12/1973 Otsuka et al.
4,914,347 A 4/1990 Osawa et al.
5,923,121 A 7/1999 Boyce et al.
6,400,097 B1 6/2002 Jin et al.
6,414,449 B1 * 7/2002 Hui et al. ..... 315/291
2001/0034148 A1 * 10/2001 Holzer ..... 439/236
2007/0138960 A1 6/2007 Karrs et al.

FOREIGN PATENT DOCUMENTS

GB 1594683 A 8/1981
JP 54090874 A * 7/1979
JP 54031980 A 9/1979
JP 56048058 A 1/1981

* cited by examiner

*Primary Examiner*—Nimeshkumar D Patel
*Assistant Examiner*—Mary Ellen Bowman
(74) *Attorney, Agent, or Firm*—Pearne & Gordon LLP

(57) ABSTRACT

A low-wattage mercury vapor discharge fluorescent lamp is provided. The lamp has a discharge sustaining fill of mercury vapor and an inert gas having 1-100 mole % xenon, balance comprising a rare gas or rare gas mixture, such as krypton or argon. The fill gas has a total pressure of 0.5-4 torr, and the lamp being adapted to operate below 10 watts per foot of arc length.

22 Claims, 1 Drawing Sheet

LOW WATTAGE FLUORESCENT LAMP

FIELD OF THE INVENTION

The present invention relates to a lamp, and more particularly to a low wattage fluorescent lamp having a fill that includes xenon.

DESCRIPTION OF RELATED ART

Linear T5 and T8 fluorescent lamps and CFL (compact fluorescent lamp) lamps having diameters of ⅜ to ⅝ inches (T3, T4, T5) have become quite popular, and have started to supplant the previous generation T12 fluorescent lamps due to their higher efficiency and compact size. This higher efficiency has been provided in part by the addition of krypton to the inert fill gas, which generally comprises argon. The addition of krypton reduces energy consumption in fluorescent lamps because krypton, having a higher atomic weight than argon, results in a lower electric field gradient in the positive column with lower heat conduction losses per unit length of discharge in the lamp. Thus, fluorescent lamps containing krypton in the fill result in lower operating costs that lead to beneficial savings for the consumer.

It is desirable to further improve the efficiency of linear fluorescent and CFL lamps or design them to consume less energy. Because lighting applications employing linear fluorescent and CFL lamps account for a significant portion of total energy consumption, an improved energy efficient or lower-power fluorescent lamp will significantly reduce total energy consumption. Such reduced energy consumption translates into cost savings to the consumer as well as reduced environmental impact associated with excess energy production necessary to meet current needs.

SUMMARY OF THE INVENTION

A mercury vapor discharge lamp comprising a light-transmissive envelope having an inner surface, a discharge-sustaining fill comprising inert gas sealed inside the envelope. The fill has a total gas pressure of 0.4-4 torr at 25° C. The lamp is adapted to operate below 10 watts per foot of arc length. The inert gas in the fill comprising (a) 0.1-99.9 mole % Xe and the balance including at least one rare gas or (b) 100 mole % xenon.

DETAILED DESCRIPTION OF THE PREFERRED EMBODIMENTS OF THE INVENTION

Figure 1:
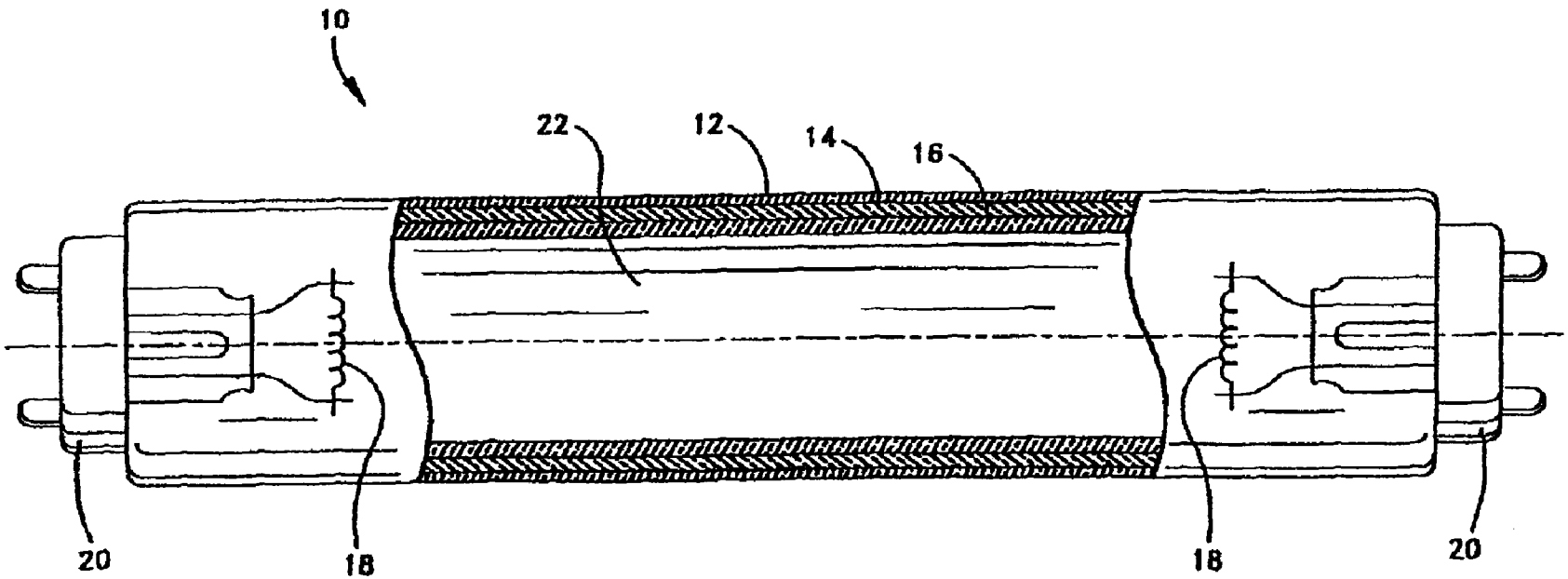
FIG. 1 shows diagrammatically, and partially in section, a lamp according to the present invention.

In the description that follows, when a preferred range, such as 5 to 25 (or 5-25), is given, this means preferably at least 5 and, separately and independently, preferably not more than 25.

With reference to FIG. 1, there is shown a low pressure mercury vapor discharge lamp 10 according to the invention, which is generally well known in the art. The lamp 10 has a light-transmissive, preferably linear and cylindrical, glass tube or envelope 12 that preferably has a circular cross section. The inner surface of the envelope 12 is preferably provided with a reflective barrier coating or layer 14 for improved light softness and brightness maintenance with age. The inner surface of the barrier layer 14 is preferably provided with a phosphor layer 16, the barrier layer 14 being between the envelope 12 and the phosphor layer 16. Phosphor layer 16 is preferably a rare earth phosphor layer, such as a rare earth triphosphor or multi-phosphor layer, or other phosphor layer. Lamp 10 can be a fluorescent lamp, such as a T12, T10 or T8 lamp, which is generally known in the art, nominally 48 inches or 4 feet in length, a cylindrical tube, and having a nominal outer diameter of at least 1 inch or an outer diameter of 1 inch or about 1 inch. The lamp 10 can also be nominally 1.5, 2, 3, 5, 6 or 8 feet long. Alternatively, the lamp 10 can be nonlinear, for example circular or otherwise curvilinear in shape, or have a nominal outer diameter less than one inch such as a T5, T4 or T3 lamp having nominal outer diameters of about 0.625 (⅝) inch, 0.5 (½) inch and 0.375 (⅜) inch, respectively. In this alternative case, the lamp 10 can also be nominally 1.5, 2, 3, 4, 5, 6 or 8 feet long, or it may be a compact fluorescent lamp having a folded or wrapped topology so that the overall length of the lamp is much shorter than the unfolded length of the glass tube.

Lamp 10 is hermetically sealed by bases 20 attached at both ends and electrodes or electrode structures 18 (to provide an arc discharge) are respectively mounted on the bases 20. A discharge-sustaining fill 22 is provided inside the sealed glass envelope, the fill comprising or being an inert gas or inert gas mixture at a low pressure in combination with a small quantity of mercury to provide the low vapor pressure manner of lamp operation.

Wattages can be measured on a standard IES 60 Hz rapid start reference circuit known in the art. Alternatively, wattages can be measured on a standard high-frequency reference circuit known in the art according to the performance specifications as specified by the International Standard IEC 60081 (2000) for double-capped fluorescent lamps. Lamp 10 may operate at 15-50, 15-40, 15-30, 15-25, 15-24, 15-23, 15-22, 15-21 or about 20, 19, 18, 17, 16 or 15, watts. Preferably, the lamp 10 operates at 4-15, preferably 4-12, preferably 4-10, preferably 4-8, or about 5, 5.5, 6, 6.5, 7 or 7.5 watts per foot of arc length. In other words, for example, a 4-foot T8 fluorescent lamp according to the present invention can operate at about 7 watts per foot of arc length, which equates to about 28 watts because a 4-foot T8 lamp generally has about 4 feet of total arc length. Arc length is the distance between the electrode structures 18 of a lamp 10 according to the present invention. For instance, a 4-foot T8 lamp generally has about 4 feet of arc length because the distance between the electrode structures 18 is about the same length of the envelope 12. Thus, in many respects, arc length of a lamp 10 is generally equal to the overall length of the light-transmissive envelope 12 of the lamp provided the bases 20 and/or electrode structure 18 do not account for a substantial portion of the lamp's 10 overall length.

The general coating structure is preferably as taught in U.S. Pat. No. 5,602,444. This coating structure is known in the art. As disclosed in the '444 patent, the barrier layer 14 comprises a blend of gamma- and alpha-alumina particles that are preferably 5-80 or 10-65 or 20-40 weight percent gamma alumina and 20-95 or 35-90 or 60-80 weight percent alpha alumina. The phosphor layer 16 is coated on the inner surface of the barrier layer 14 and preferably has a coating weight of 1-5 or 2-4 mg/cm$^2$ or other conventional coating weight. The phosphor layer 16 preferably comprises a mixture of red, green and blue emitting rare earth phosphors, preferably a triphosphor blend. Rare earth phosphor blends comprising other numbers of rare earth phosphors, such as blends with 4 or 5 rare earth phosphors, may be used in the phosphor layer 16.

The inert gas in the fill preferably comprises xenon and at least one other rare gas such as neon, argon or krypton. The inert gas is 0.1-99.9, preferably 0.1-80, preferably 0.1-60, preferably 0.1-50, preferably 0.1-40, preferably 0.1-30, preferably 0.1-25, preferably 0.1-20, preferably 0.1-15, or about or less than 2, 3, 4, 5, 6, 7, 8, 9, 10, 11, 12, 13, or 14, mole % xenon, balance including a rare gas or rare gas mixture. In preferred embodiments, the inert gas having at least 15 mole % xenon, the balance including a rare gas or rare gas mixture, such as krypton, argon or neon or combinations thereof. In another preferred embodiment, the inert gas includes less than about 5, 10, 15, 20, 25, 30 or 35 mole % xenon, the balance a rare gas or rare gas mixture, such as more than about 50, 60, 65, 70, 75 or 80 mole % krypton or less than about 5, 10, 15 or 20 mole % argon. Alternatively, the inert gas can be 100% substantially pure xenon or about 100 mole % xenon. The total pressure of the fill 22 (including mercury vapor and inert gas) is preferably 0.4-4, preferably 0.4-2, preferably 0.4-1.8, more preferably about 0.4-1.6, torr at the conventional fill temperature as known in the art, for example 25° C.

A lamp 10 according to the present invention, though nominally more costly due to material costs, generally consumes less energy due to the reduced wattage required to operate the lamp when used in conjunction with existing ballasts. The nominal wattage in an existing high performance T8 fluorescent lamp, such as the General Electric F28T8 Ultramax lamp, is about 28 watts. As shown in Example 1 below, in a preferred embodiment, the invented lamp 10 preferably operates at less than or about 25 watts (i.e. about 6.25 watts per foot of arc length for a 4-foot linear fluorescent lamp) under standard reference photometry conditions on a 120V 60 Hz circuit, or about at 10% less power than the above-mentioned standard high performance T8 fluorescent lamp. The lumen output or lumen efficiency of a lamp 10 according to the present invention can be adjusted to match the lumen output or lumen efficiency of existing high performance, low-wattage fluorescent lamps by altering or modifying the materials that compose the phosphor layer 16 of the lamp 10.

It is believed that one benefit of the invention is that the addition or substitution of xenon in the inert gas results in a lamp 10 with a maximum lumen efficiency at a bulb or envelope operating temperature above at least 40, preferably 42, preferably 44, preferably 46 or about 47, 48, 49 or about 50, ° C. It is often the case that existing fluorescent lamps operate with envelope or bulb temperatures higher than the optimal lumen efficiency temperature range for the inert gas or gases in the fill, such as krypton or argon. Hence, it is thought that lamps 10 of the present invention consume less energy and have peak lumen efficiency at bulb operating temperatures above those of high performance fluorescent lamps known in the art.

The invention will be understood, and particular aspects of the invention further described, in conjunction with the following example.

EXAMPLE 1

Pressure measurements in this Example are at 25° C. A series of low-wattage 4-foot T8 lamps according to the present invention were tested on a standard 120V 60 Hz circuit, as noted above, under standard reference photometry conditions. The average watt usage of 3 such lamps was compared with that of 3 standard 4-foot T8 lamps having inert gas compositions of krypton, argon or mixtures thereof on the same circuit. The results are shown below in Table 1. The power measurements (Watts) of Table 1 indicate the effective arc wattage of the tested lamps. The arc wattage measurement excludes the power consumed by the cathodes of the reference circuit. Normal applications of the lamp 10 of the present invention would not include cathode power, end losses or non-light producing watt measurements and thus these are removed from the power measurements of Table 1.

TABLE 1

Comparison of Invented Lamps and Standard Fluorescent Lamps

| Lamp | Inert Fill Gas Composition (mole %) | Total Pressure (torr) | Power (Watts) |
|---|---|---|---|
| Std. T8 | 100% Kr | 1.6 | 25.1 |
| Std. T8 | 50% Kr<br>50% Ar | 1.6 | 28.4 |
| Std. T8 | 75% Kr<br>25% Ar | 1.6 | 26.8 |
| Invented T8 | 75% Kr<br>25% Xe | 1.6 | 22.6 |
| Invented T8 | 50% Kr<br>50% Xe | 1.6 | 19.8 |
| Std. T8 | 100% Kr | 1.8 | 25 |
| Invented T8 | 90% Kr<br>10% Xe | 1.8 | 24.8 |
| Invented T8 | 75% Kr<br>25% Xe | 1.8 | 23 |
| Std. T8 | 100% Ar | 2 | 31.2 |
| Invented T8 | 70% Ar<br>30% Xe | 2 | 26.4 |
| Invented T8 | 100% Xe | 2 | 15.9 |

As can be seen in Table 1, the invented T8 lamps consume less power than standard T8 fluorescent lamps having an inert fill gas of krypton, argon or mixtures thereof. At a total fill pressure of 1.6 torr, the standard T8 lamps yielded a power level of 25.1 watts (i.e. std. T8 lamp with 100% Kr) while the invented T8 lamps yielded a power level of 19.8 watts (i.e. invented T8 lamp with 50% Kr, 50% Xe), or about 20% less power than the lowest wattage standard T8 lamp. At a total pressure of 1.8 torr, the standard T8 lamp yielded a power level of 25 watts (i.e. std. T8 lamp with 100% Kr) while the invented T8 lamps yielded a power level of 23 watts (i.e. invented T8 lamp with 75% Kr, 25% Xe), or about 8% less power. At a total pressure of 2 torr, the standard T8 lamp yielded a power level of 31.2 watts (i.e. std. T8 lamp with 100% Ar) while the invented T8 lamps yielded a power level of 15.9 watts (i.e. invented T8 lamp with 100% Xe), or about 50% less power. Thus, the invented T8 lamps result in a decrease in power consumption over a range of total fill gas pressures and Xe mole % fill gas compositions. The invented low-wattage 4-foot linear T8 lamp preferably consumes not more than 24.8, 24.2, 23.6, 23, 22.6, 22, 21.6, 21, 20.6, 20, 19.6, 19, 18, 17, 16 or 15.9 watts (i.e. not more than 6.2, 6.05, 5.9, 5.75, 5.65, 5.5, 5.4, 5.25, 5.15, 5, 4.9, 4.5, 4.25, 4 or 3.98 watt per foot of arc length) when operated on the reference 120V 60 Hz circuit. It is further believed that the addition or substitution of xenon in the inert gas of the fill in all cases results in a reduction of the wattage of a lamp 10 as measured on the reference circuit when compared with a similarly configured lamp not containing xenon in the inert gas of the fill. Similar reductions in wattage are achieved by an invented lamp having configurations other than a T8 lamp, such as a T5, T4, T3 or CFL fluorescent lamp. Consequently, variations in lamp diameter (i.e. greater or less than the diameter of a T12 or T3, respectively), length, and other parameters are possible without deviating from the scope of the invention.

EXAMPLE 2

Pressure measurements in this Example are at 25° C. A series of lamps according to the present invention were tested on a high frequency 26 kHz ballast according to the performance specifications as specified by the International Standard IEC 60081 (2000) for double-capped fluorescent lamps. The wattage of the lamps according to the present invention was compared with standard lamps containing only argon and krypton in the fill on the same circuit. The results are shown below in Table 2.

TABLE 2

Comparison of Invented Lamps and Standard Fluorescent Lamps

| Lamp | Inert Fill Gas Composition (mole %) | Total Pressure (torr) | Power (Watts) |
|---|---|---|---|
| Invented 5-foot T5 | 96% Ar<br>4% Xe | 3 | 33.6 |
| Std. 5-foot T5 | 89% Ar<br>11% Kr | 3 | 36.6 |
| Std. 5-foot T5 | 76% Ar<br>24% Kr | 3 | 34 |
| Invented 4-foot T5 | 77% Ar<br>23% Xe | 3 | 19.3 |
| Std. 4-foot T5 | 89% Ar<br>11% Kr | 3 | 28.2 |
| Std. 4-foot T5 | 87% Ar<br>13% Kr | 3 | 27.8 |
| Std. 4-foot T5 | 78% Ar<br>22% Kr | 3 | 26.9 |
| Std. 4-foot T5 | 76% Ar<br>24% Kr | 3 | 26.5 |
| Std. 4-foot T5 | 68% Ar<br>32% Kr | 3 | 25.6 |
| Invented 2-foot T5 | 96% Ar<br>4% Xe | 3 | 12 |
| Std. 2-foot T5 | 100% Ar | 3 | 14.3 |
| Std. 2-foot T5 | 90% Ar<br>10% Kr | 3 | 13.8 |
| Std. 2-foot T5 | 80% Ar<br>20% Kr | 3 | 13.2 |
| Std. 2-foot T5 | 76% Ar<br>24% Kr | 3 | 13.2 |

As can be seen in Table 2, the invented T5 lamps consume less power than standard T5 lamps having an inert fill gas of krypton and argon. For example, the standard 5-foot T5 lamps yielded a power level of at least 34 watts (i.e. std. 5-foot T5 lamp with 76% Ar, 24% Kr) while the invented 5-foot T5 lamp yielded a power level of 33.6 watts (i.e. invented 5-foot T5 lamp with 96% Ar, 4% Xe). The standard 4-foot T5 lamps yielded a power level of at least 25.6 watts (i.e. std. 4-foot T5 lamp with 68% Ar, 32% Kr) while the invented 4-foot T5 lamp yielded a power level of 19.3 watts (i.e. invented 4-foot T5 lamp with 77% Ar, 23% Xe). The standard 2-foot T5 lamps yielded a power level of at least 13.2 watts (i.e. std. 2-foot T5 lamp with 76% Ar, 24% Kr) while the invented 2-foot T5 lamp yielded a power level of 12 watts (i.e. invented 2-foot T5 lamp with 96% Ar, 4% Xe). Thus, the invented T5 lamps result in a decrease in power consumption over a range of Xe mole % fill gas compositions. The invented low-wattage 4-foot linear T5 lamp preferably consumes not more than 20, 19.6, 19.3, 18.6, 18.2, 17.6, 17.2, 16.8, 16.2, 15.8 or 15 watts (i.e. not more than 5, 4.9, 4.83, 4.65, 4.55, 4.4, 4.3, 4.2, 4.05, 3.95 or 3.75 watt per foot of arc length) when operated on the reference circuit as specified by the International Standard IEC 60081 (2000) for double-capped fluorescent lamps. It is further believed that the addition or substitution of xenon in the inert gas of the fill in all cases results in a reduction of the wattage of a lamp 10 as measured on the reference circuit as specified by the International Standard IEC 60081 (2000) for double-capped fluorescent lamps when compared with a similarly configured lamp not containing xenon in the inert gas of the fill. Similar reductions in wattage are achieved by an invented lamp having configurations other than a T5 lamp, such as a T4, T3 or CFL lamp. Consequently, variations in lamp diameter, length, and other parameters are possible without deviating from the scope of the invention.

A lamp 10 according to the present invention will have substantially similar color rendering index (CRI) characteristics compared to equivalent commercially-available fluorescent lamps. Hence, the invented lamps can be employed in virtually all lighting applications where current T8, T5, T4, T3 or CFL lamps are used. In this regard, the CRI characteristics being similarly tunable through proper selection of triphosphor weight percent ratios in the phosphor layer 16.

While the invention has been described with reference to preferred embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A mercury vapor discharge lamp comprising a light-transmissive envelope having an inner surface, a discharge-sustaining fill comprising inert gas sealed inside said envelope, said fill having a gas pressure of 0.4-4 torr at 25° C., said lamp adapted to operate below about 10 watts per foot of arc length, the inert gas in the fill comprising (a) greater than 25 mole % xenon, balance comprising at least one rare gas or (b) greater than 0 to 25 mole % xenon, balance comprising less than 20 mole % argon.

2. The lamp of claim 1, the inert gas being about 25-50 mole % xenon, balance comprising krypton.

3. The lamp of claim 1, the inert gas being about 25-60 mole % xenon, balance comprising argon.

4. The lamp of claim 3, the balance further comprising krypton.

5. A mercury vapor discharge lamp comprising a light-transmissive envelope having an inner surface, a discharge-sustaining fill comprising inert gas sealed inside said envelope, said fill having a gas pressure of 0.4-4 torr at 25° C., said lamp adapted to operate below about 10 watts per foot of arc length, the inert gas in the fill comprising (a) about 40-60 mole % xenon, balance comprising argon and krypton or (b) greater than 0 to 25 mole % xenon, balance comprising less than 20 mole % argon.

6. The lamp of claim 1, said lamp further comprising a phosphor layer inside the envelope and adjacent the inner surface of the envelope.

7. The lamp of claim 6, said lamp further comprising a barrier layer between the envelope and the phosphor layer.

8. The lamp of claim 1, said lamp operating on an IES 60 Hz rapid start reference circuit.

9. The lamp of claim 1, said lamp operating on a high frequency 26 kHz ballast according to the performance specifications as specified by the International Standard IEC 60081 for double-capped fluorescent lamps.

10. The lamp of claim 1, said lamp adapted to operate below about 8 watts per foot of arc length.

11. The lamp of claim 1, said lamp adapted to operate at not more than about 7 watts per foot of arc length when operated on a 120 V 60 Hz reference circuit.

12. The lamp of claim 1, said lamp adapted to operate at not more than about 6 watts per foot of arc length when operated on a high frequency 26 kHz ballast according to the performance specifications as specified by the International Standard IEC 60081 for double-capped fluorescent lamps.

13. The lamp of claim 1, said lamp being a T8 fluorescent lamp.

14. The lamp of claim 13, wherein said lamp is 4 feet in length.

15. The lamp of claim 1, said lamp being a T5 fluorescent lamp.

16. The lamp of claim 15, wherein said lamp is 4 feet in length.

17. The lamp of claim 1, said lamp having a fill gas pressure of 0.4-2.5 torr at 25° C.

18. The lamp of claim 1, said lamp having a nominal outer diameter of about 1.5 inch or less.

19. The lamp of claim 1, said lamp having a nominal outer diameter of less than about 1 inch.

20. A mercury vapor discharge lamp comprising a light-transmissive envelope having an inner surface, a discharge-sustaining fill comprising inert gas sealed inside said envelope, said fill having a gas pressure of 0.4-4 torr at 25° C., said lamp adapted to operate below about 10 watts per foot of arc length, the inert gas in the fill comprising (a) about 20-40 mole % xenon, balance comprising more than 50 mole % krypton or (b) greater than 0 to 25 mole % xenon, balance comprising less than 20 mole % argon.

21. A mercury vapor discharge lamp comprising a light-transmissive envelope having an inner surface, a discharge-sustaining fill comprising inert gas sealed inside said envelope, said fill having a gas pressure of 0.4-4 torr at 25° C., said lamp adapted to operate below about 10 watts per foot of arc length, the inert gas in the fill comprising less than 20 mole % argon, the balance being krypton and xenon.

22. A mercury vapor discharge lamp comprising a light-transmissive envelope having an inner surface, a discharge-sustaining fill comprising inert gas sealed inside said envelope, said fill having a gas pressure of 0.4-4 torr at 25° C., said lamp adapted to operate below about 10 watts per foot of arc length, the inert gas in the fill comprising (a) about 15-40 mole % xenon, balance comprising more than 50 mole % krypton or (b) greater than 0 to 25 mole % xenon, balance comprising less than 20 mole % argon.

* * * * *